US010059407B1

(12) United States Patent
Ingalls et al.

(10) Patent No.: US 10,059,407 B1
(45) Date of Patent: Aug. 28, 2018

(54) WATERCRAFT SEAT ACCESSORY ADAPTOR SYSTEMS

(71) Applicants: Jason Ingalls, Alexandria, LA (US); Randy Ingalls, Alexandria, LA (US)

(72) Inventors: Jason Ingalls, Alexandria, LA (US); Randy Ingalls, Alexandria, LA (US)

( * ) Notice: Subject to any disclaimer, the term of this patent is extended or adjusted under 35 U.S.C. 154(b) by 0 days.

(21) Appl. No.: 15/473,796

(22) Filed: Mar. 30, 2017

(51) Int. Cl.

| | |
|---|---|
| ***A47C 7/66*** | (2006.01) |
| ***A47C 7/68*** | (2006.01) |
| ***B63B 17/02*** | (2006.01) |
| ***B63B 29/06*** | (2006.01) |
| *B63B 29/04* | (2006.01) |

(52) U.S. Cl.
CPC ..... *B63B 17/02* (2013.01); *B63B 29/06* (2013.01); *B63B 2029/043* (2013.01); *B63B 2709/00* (2013.01)

(58) Field of Classification Search
CPC ... B63B 17/02; B63B 29/06; B63B 2029/043; B63B 2709/00
USPC ..... 297/184.1, 184.11, 184.16; 248/125.7, 248/315, 415
See application file for complete search history.

(56) References Cited

U.S. PATENT DOCUMENTS 793,233 A * 6/1905 Ryan ..... F16M 13/02 248/282.1
2,375,696 A * 5/1945 Shick ..... A47B 19/002 297/188.21 X
2,542,653 A * 2/1951 Frydenlund ..... A47C 1/08 297/234
2,694,439 A * 11/1954 Murray ..... A47C 1/08 248/282.1
3,295,473 A * 1/1967 Wentworth ..... A47B 31/06 108/152
3,601,443 A * 8/1971 Jones ..... A47C 1/11 297/188.21 X
3,712,669 A * 1/1973 Cates ..... A47C 1/04 297/188.21
3,784,250 A * 1/1974 Beeman ..... A45B 17/00 297/184.1
4,136,908 A * 1/1979 Crayne ..... A47C 1/11 297/188.21
4,318,567 A * 3/1982 Guthier ..... A47C 15/004 297/184.16 X
4,500,134 A * 2/1985 Kaneko ..... A61G 15/14 297/170 X
4,597,356 A * 7/1986 McCaghren ..... B63B 29/04 114/153
4,645,167 A * 2/1987 Hardwick ..... B63B 29/04 297/184.16 X
4,766,838 A * 8/1988 Johnson ..... B63B 29/04 114/363

(Continued)

*Primary Examiner* — Rodney B White
(74) *Attorney, Agent, or Firm* — R. Keith Harrison

(57) ABSTRACT

A watercraft seat accessory adaptor system for mounting a canopy assembly on a watercraft includes a watercraft seat mount assembly including a base portion, a seat portion carried by the base portion and a watercraft seat carried by the seat portion. An accessory support member includes an elongated base segment carried by the seat portion of the watercraft seat mount assembly in rotatable relation to the seat portion. An accessory mount segment may be carried by the base segment. The accessory mount segment may be suitably configured for mounting the canopy assembly.

11 Claims, 10 Drawing Sheets

(56) References Cited

U.S. PATENT DOCUMENTS 4,823,723 A * 4/1989 Brooks ..... A01K 97/10 114/343
4,927,117 A 5/1990 Gainey
4,932,152 A * 6/1990 Barlotta ..... A01K 97/10 248/515
4,936,594 A * 6/1990 Oliver, III ..... A47B 81/06 280/47.19
4,979,458 A * 12/1990 Bouza ..... B63B 29/04 114/363
5,000,412 A * 3/1991 Sheehan ..... A01K 97/06 248/286.1
5,022,420 A 6/1991 Brim
5,158,074 A * 10/1992 Grellas ..... A61H 1/0274 297/188.21
D330,630 S * 11/1992 Loden ..... D3/10
5,163,451 A * 11/1992 Grellas ..... A61H 1/0274 128/898
5,232,005 A 8/1993 Mitchell
5,255,954 A 10/1993 Rogers
D371,595 S * 7/1996 Pieper ..... D22/147
D399,367 S * 10/1998 Sieland ..... D6/708.16
5,842,732 A 12/1998 Daggett et al.
5,857,741 A * 1/1999 Anderson ..... A47B 83/02 297/170 X
5,906,077 A * 5/1999 Andiarena ..... E04H 12/2223 135/118
5,950,617 A * 9/1999 Lorenz ..... B60R 9/06 108/44
5,992,804 A * 11/1999 Johnson ..... B63B 29/06 114/363
6,059,351 A 5/2000 Ehnes
6,082,269 A * 7/2000 Padberg ..... B60R 9/06 108/44
6,105,594 A 8/2000 Diaz
6,189,458 B1 * 2/2001 Rivera ..... B60N 3/001 108/150
6,314,891 B1 * 11/2001 Larson ..... A47B 3/14 108/44
6,371,139 B1 * 4/2002 Simchori ..... E04H 12/2223 297/184.16 X
6,637,815 B1 10/2003 Louque et al.
6,681,517 B1 * 1/2004 Solomon ..... A01K 97/10 43/21.2
6,722,380 B1 * 4/2004 Hafer ..... B60R 9/06 135/16
6,752,088 B2 * 6/2004 Poarch ..... A47B 83/02 108/44
6,776,452 B2 * 8/2004 Onishi ..... A47B 83/02 297/188.21 X
6,808,231 B1 * 10/2004 Hill ..... B60R 9/06 297/188.01 X
6,845,780 B2 1/2005 Bishirjian
7,047,688 B2 * 5/2006 Sandman, Jr. ..... A01K 97/10 248/512
7,073,857 B1 * 7/2006 Bailey ..... A47C 3/0255 224/547
7,334,593 B2 * 2/2008 Avery ..... A45B 1/00 108/50.12
7,540,561 B2 6/2009 McWhorter et al.
8,123,190 B2 * 2/2012 Kost ..... A45B 11/00 135/88.08
8,210,193 B2 7/2012 Ortiz et al.
8,251,455 B1 * 8/2012 Midkiff ..... A01K 97/22 297/143 X
8,291,832 B2 * 10/2012 Fisher ..... A47B 37/04 108/44
8,297,699 B1 * 10/2012 Midkiff ..... A01K 97/22 297/143
8,308,123 B1 * 11/2012 Accordino ..... A45B 11/00 248/156
8,485,207 B1 * 7/2013 Boyington ..... E04H 15/06 135/16
8,544,943 B2 * 10/2013 Fields ..... A47C 1/11 297/188.01
8,720,708 B1 * 5/2014 Gilmore ..... A47G 7/041 108/92
9,113,717 B2 * 8/2015 Edwards ..... A47C 15/004
9,127,475 B2 * 9/2015 LeAnna ..... E04H 12/2284
9,357,756 B2 * 6/2016 Davis ..... A01K 97/04
9,555,862 B1 * 1/2017 Sutherland ..... B63B 17/04
9,701,255 B2 * 7/2017 Brown ..... B60R 9/00
9,821,889 B2 * 11/2017 O'Neal ..... B63B 29/06
2004/0112416 A1 6/2004 Bishirjian
2005/0126064 A1 * 6/2005 Winkler ..... A01K 97/06 43/21.2
2005/0241546 A1 * 11/2005 Royse ..... A47B 37/04 108/44
2006/0162622 A1 * 7/2006 Fisher ..... A47B 37/04 108/44
2006/0254635 A1 * 11/2006 Matheus ..... E04H 6/04 135/88.05
2006/0272688 A1 12/2006 McWhorter et al.
2007/0216205 A1 * 9/2007 Davis ..... A47C 1/08 297/241
2010/0059093 A1 * 3/2010 Clark ..... A45B 11/00 135/16
2013/0247435 A1 * 9/2013 Bacik ..... G09F 23/00 40/606.03

* cited by examiner

WATERCRAFT SEAT ACCESSORY ADAPTOR SYSTEMS

FIELD

Illustrative embodiments of the disclosure generally relate to watercraft seats for seating occupants in a watercraft. More particularly, illustrative embodiments of the disclosure relate to watercraft seat accessory adaptor systems which facilitate multi-positional mounting of a canopy such as an umbrella on a watercraft seat.

SUMMARY

Illustrative embodiments of the disclosure are generally directed to a watercraft seat accessory adaptor system for mounting a canopy assembly on a watercraft. An illustrative embodiment of the watercraft seat accessory adaptor system includes a watercraft seat mount assembly including a base portion, a seat portion carried by the base portion and a watercraft seat carried by the seat portion. An accessory support member includes an elongated base segment carried by the seat portion of the watercraft seat mount assembly in rotatable relation to the seat portion. An accessory mount segment may be carried by the base segment. The accessory mount segment may be suitably configured for mounting the canopy assembly.

BRIEF DESCRIPTION OF THE DRAWINGS

Illustrative embodiments of the disclosure will now be described, by way of non-limiting example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
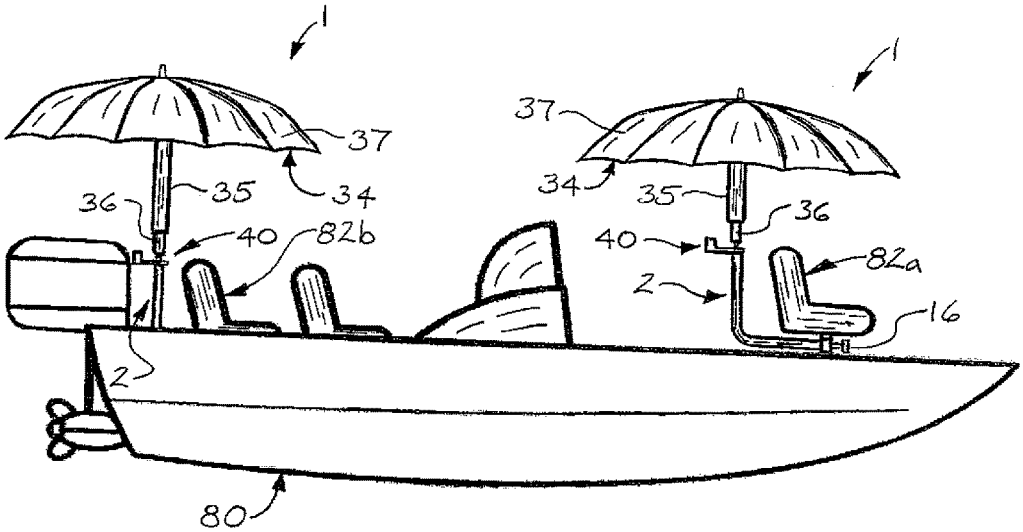
FIG. 1 is a side view of a typical watercraft fitted with a pair of watercraft seat accessory adaptor systems according to an illustrative embodiment of the disclosure, with canopies mounted on the respective watercraft seat accessory adaptor systems and each deployed in an open, functional configuration.
Figure 2:
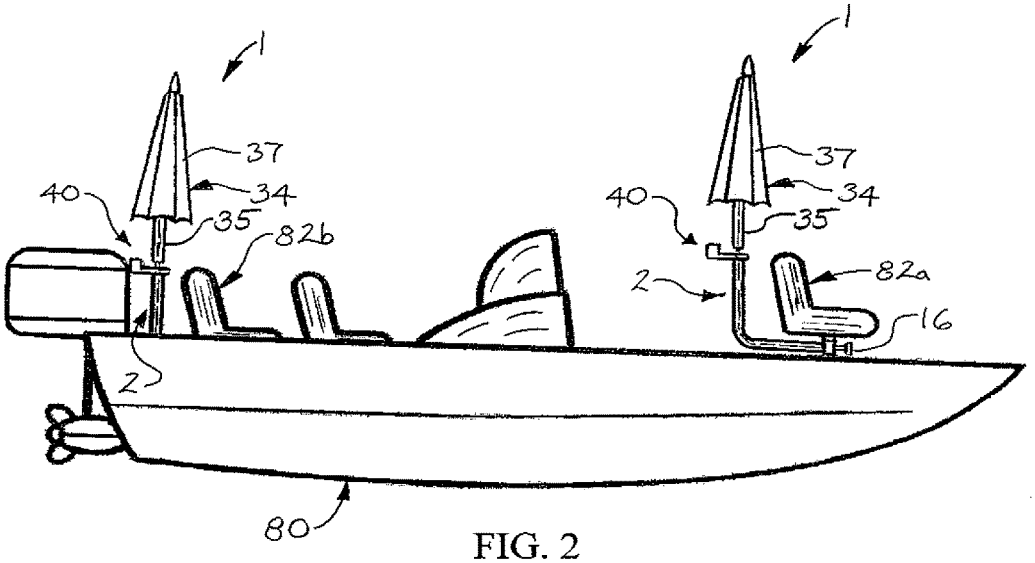
FIG. 2 is a side view of the watercraft illustrated in FIG. 1, with the canopies on the respective watercraft seat accessory adaptor systems each deployed in a closed, nonfunctional configuration.

Referring initially to FIGS. 1-16 of the drawings, an illustrative embodiment of the watercraft seat accessory adaptor systems, hereinafter system, is generally indicated by reference numeral 1. As illustrated in FIGS. 1 and 2 and will be hereinafter further described, in typical application, the system 1 may facilitate mounting of at least one canopy assembly 34 over at least one watercraft seat 82 on a watercraft 80. In some embodiments, the canopy assembly 34 may include a conventional umbrella. The system 1 may facilitate mounting of umbrellas of various sizes and brands on the watercraft 80.

Figure 3:
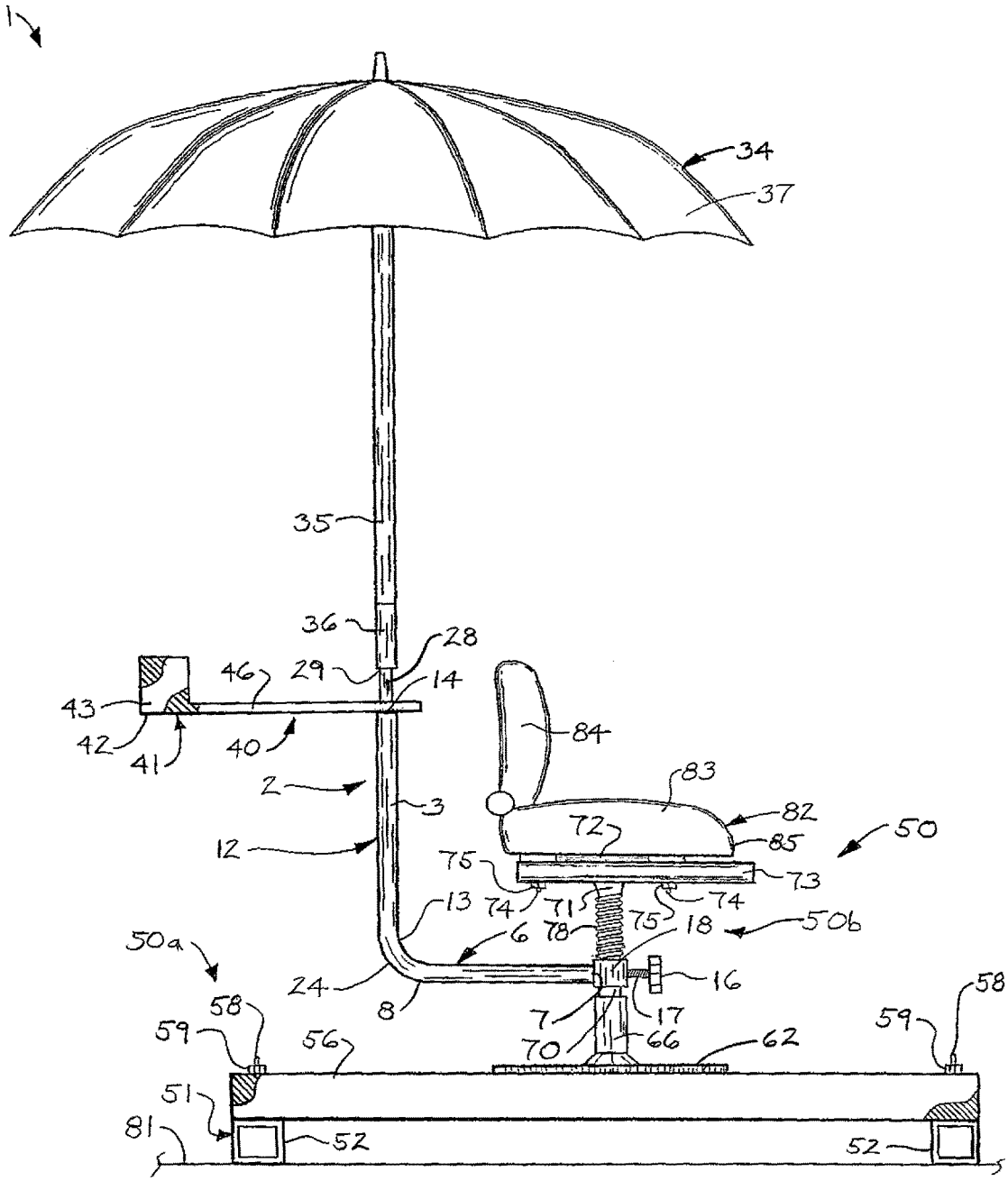
FIG. 3 is a side view of an illustrative watercraft seat accessory adaptor system, with the canopy deployed in the open, functional configuration.
Figure 4:
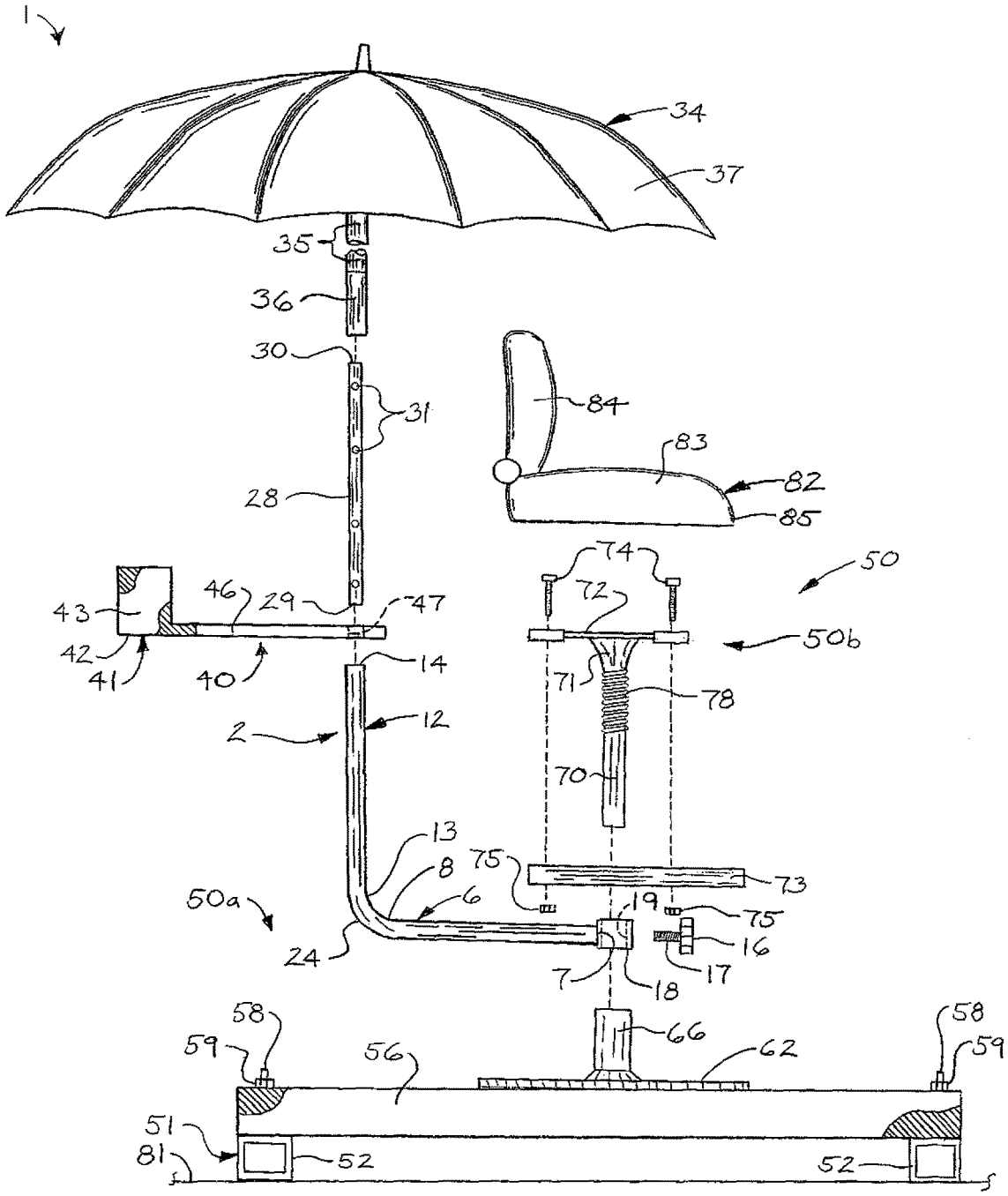
FIG. 4 is an exploded side view of the illustrative watercraft seat accessory adaptor system illustrated in FIG. 3.
Figure 5:
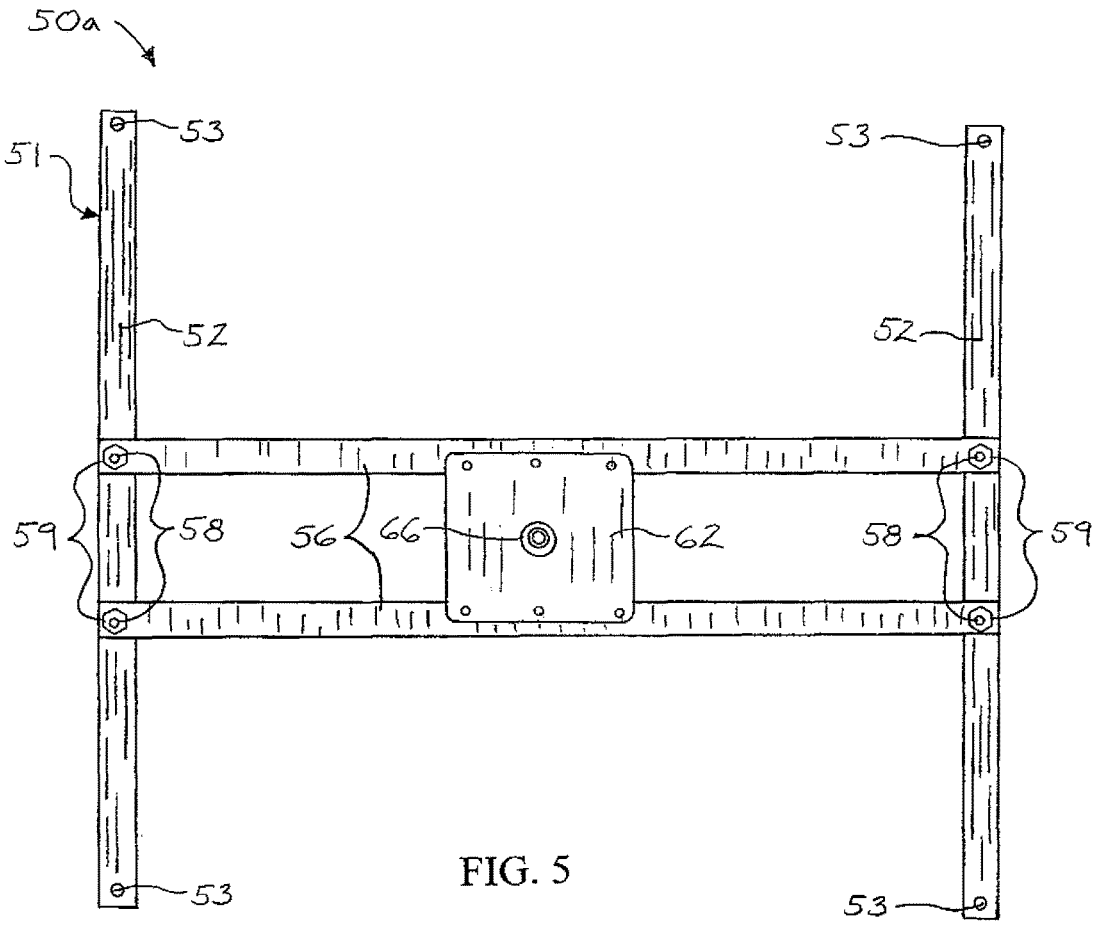
FIG. 5 is a top view of a base portion of a typical seat mount assembly according to an illustrative embodiment of the watercraft seat accessory adaptor systems.

As illustrated in FIGS. 3 and 4, in some embodiments, the system 1 may include a watercraft seat mount assembly 50. The watercraft seat mount assembly 50 may include a base portion 50*a* and a seat portion 50*b* on the base portion 50*a*. In some embodiments, the base portion 50*a* of the watercraft seat mount assembly 50 may include a seat mount assembly base 51. As illustrated in FIGS. 3-5, the seat mount assembly base 51 may include a pair of generally elongated, parallel, spaced-apart base members 52. The base members 52 may be secured to the watercraft floor 81 or other surface of the watercraft 80 using suitable fasteners (not illustrated) which may be extended through fastener openings 53 in the base members 52. A pair of generally elongated, parallel, spaced-apart seat mount members 56 may extend between the base members 52 in perpendicular relationship thereto. The seat mount members 56 may be attached to the base members 52 via seat mount member fasteners 58 and securing nuts 59. A base plate 62 may be provided on the seat mount members 56. A seat post receptacle 66 may extend upwardly from the base plate 62 for purposes which will be hereinafter described.

Figure 6:
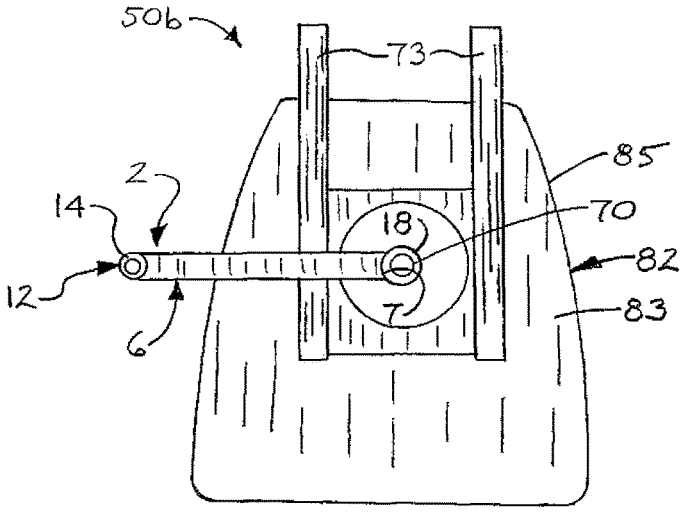
FIG. 6 is a bottom view of a seat portion of a typical seat mount assembly, with an accessory support member mounted on the seat portion according to an illustrative embodiment of the watercraft seat accessory adaptor systems.

As illustrated in FIGS. 3, 4 and 6, the seat portion 50*b* of the watercraft seat mount assembly 50 may include a seat pedestal 70. The seat pedestal 70 may be suitably sized and configured for insertion into the seat post receptacle 66. A pedestal head 71 may terminate an upper end of the seat pedestal 70. A pedestal plate 72 may be provided on the pedestal head 71.

The watercraft seat 82 may be mounted on the pedestal plate 72 according to the knowledge of those skilled in the art. The watercraft seat 82 may include a seat portion 83 which engages an upper surface of the pedestal plate 72 and a backrest portion 84 which extends from the seat portion 83. Multiple seat fasteners (not illustrated) may secure the pedestal plate 72 to a lower surface of the seat portion 83 of the watercraft seat 82. In some embodiments, a pair of generally elongated, parallel, spaced-apart pedestal mount members 73 may be secured to a lower surface of the pedestal plate 72 using multiple mount member fasteners 74 and securing nuts 75. A separate set of fasteners (not illustrated) may attach the pedestal mount members 73 to the lower surface of the seat portion 83. Accordingly, the pedestal plate 72 may be clamped between the pedestal mount members 73 and the seat portion 83 of the watercraft seat 82 to secure the watercraft seat 82 on the seat pedestal 70. It will be recognized and understood that the base portion 50*a* and/or the seat portion 50*b* of the watercraft seat mount assembly 50 may have any suitable alternative designs known by those skilled in the art suitable for mounting the watercraft seat 82 on the watercraft floor 81 or other surface of the watercraft 80.

Figure 7:
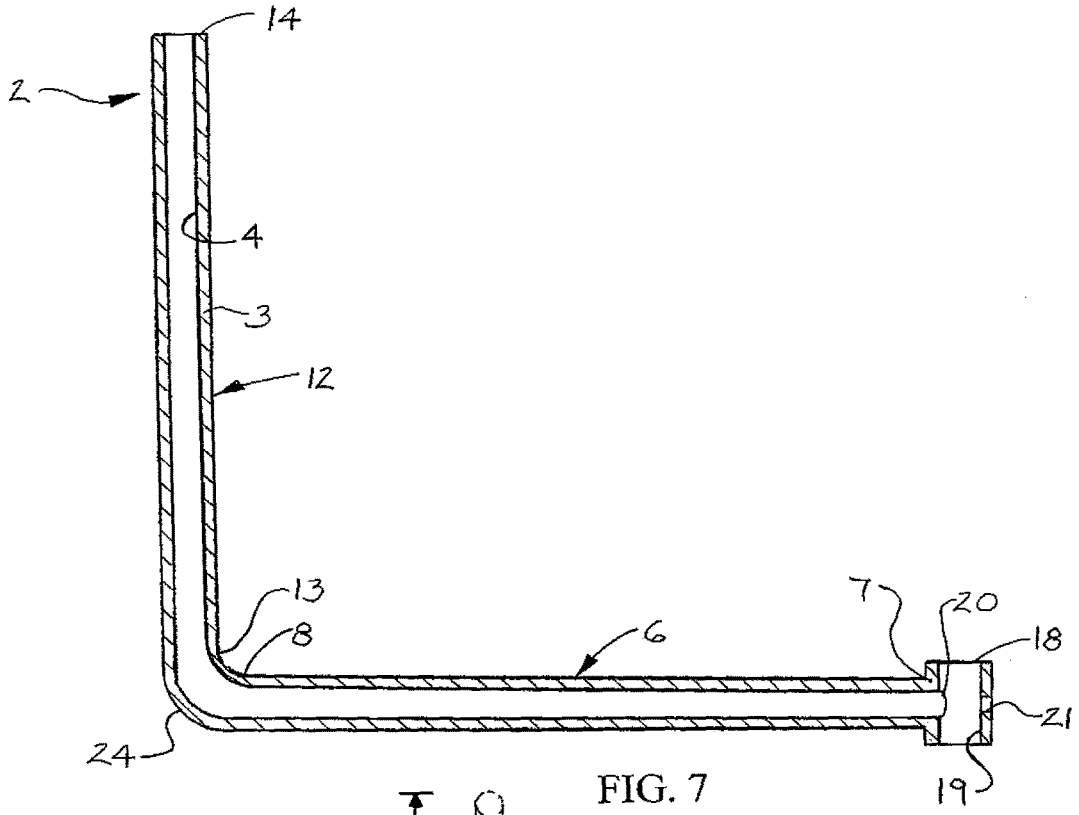
FIG. 7 is a longitudinal sectional view of a typical accessory support member of an illustrative embodiment of the watercraft seat accessory adaptor systems.

An accessory support member 2 may be mounted for rotation relative to the seat portion 50*b* typically in a manner which will be hereinafter described. As illustrated in FIG. 7, the accessory support member 2 may be generally L-shaped with an elongated base segment 6 having a proximal base segment end 7 and a distal base segment end 8. An accessory mount segment 12 may extend from the distal base segment end 8 of the base segment 6 at a support member bend 24. The accessory mount segment 12 may include a proximal mount segment end 13 at the support member bend 24 and a distal mount segment end 14 opposite the proximal mount segment end 13. In some embodiments, the base segment 6 and the accessory mount segment 12 of the accessory support member 2 may include a support member wall 3 which surrounds a support member interior 4.

As further illustrated in FIG. 7, a seat post collar 18 may be provided on the proximal base segment end 7 of the base segment 6. The seat post collar 18 may facilitate rotatable mounting of the accessory support member 2 relative to the seat pedestal 70 (FIGS. 3 and 4) of the watercraft seat mount assembly 50. Accordingly, the seat post collar 18 may have a collar interior 19 which is suitably sized and configured to receive and accommodate the seat pedestal 70. A collar opening 20 may establish communication between the support member interior 4 of the base segment 6 and the collar interior 19 of the seat post collar 18. A threaded knob shaft opening 21 may be provided in the seat post collar 18 in communication with the collar interior 19. The knob shaft opening 21 may receive a threaded knob shaft 17 on a hand-adjustable knob 16 to facilitate securing of the seat post collar 18 at a selected position on the seat pedestal 70 by threaded engagement of the knob shaft 17 against the seat pedestal 70 by rotation of the knob 16. As illustrated in FIGS. 3 and 4, in some embodiments, a seat spring 78 may be interposed between the seat post collar 18 of the accessory support member 2 and the pedestal head 71 on the seat pedestal 70 to cushion the watercraft seat 82 on the watercraft seat mount assembly 50.

Figure 8:
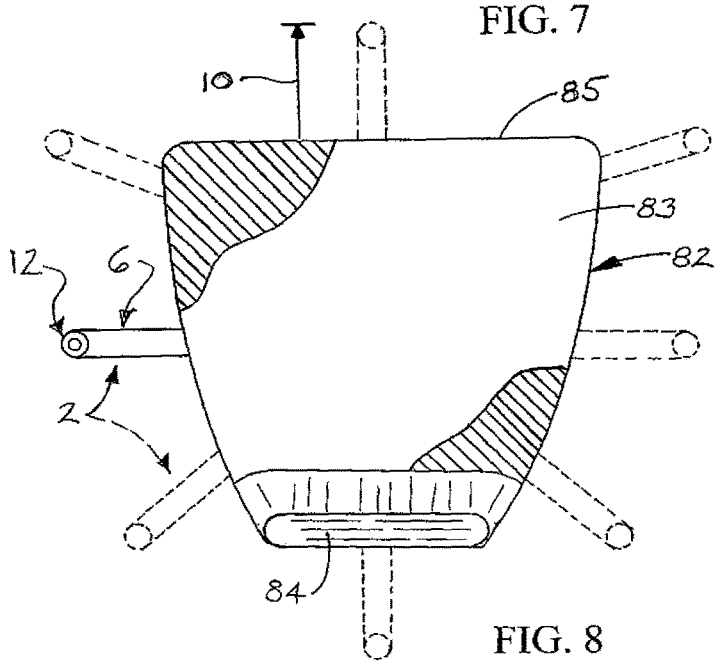
FIG. 8 is a top view of a watercraft seat with a typical accessory support member of an illustrative watercraft seat accessory adaptor system mounted on the watercraft seat, more particularly illustrating selective multi-positioning capability of the accessory support member relative to the watercraft seat.
Figure 9:
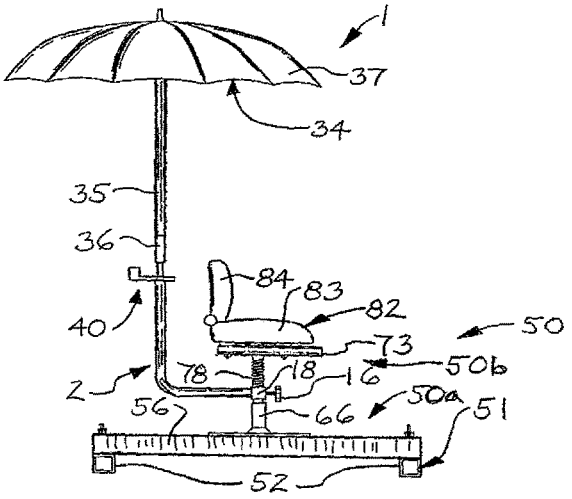
FIG. 9 is a side view of an illustrative watercraft seat accessory adaptor system mounting a canopy assembly on a watercraft seat, with a canopy of the canopy assembly deployed in an open, functional configuration and disposed in a rear position relative to the watercraft seat.
Figure 10:
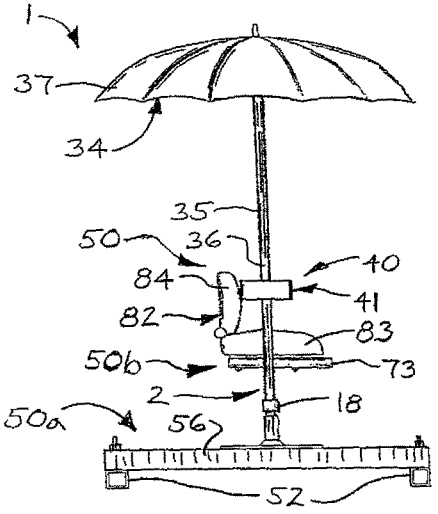
FIG. 10 is a side view of the illustrative watercraft seat accessory adaptor system with the open canopy of the canopy assembly disposed in a right side position relative to the watercraft seat.
Figure 11:
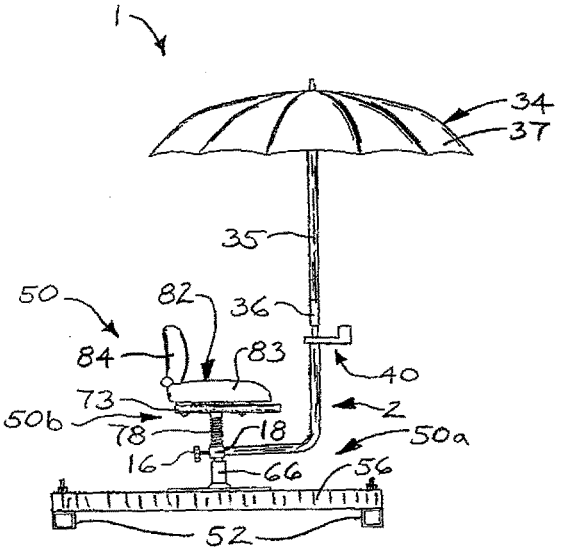
FIG. 11 is a side view of the illustrative watercraft seat accessory adaptor system with the open canopy of the canopy assembly disposed in a front position relative to the watercraft seat.
Figure 12:
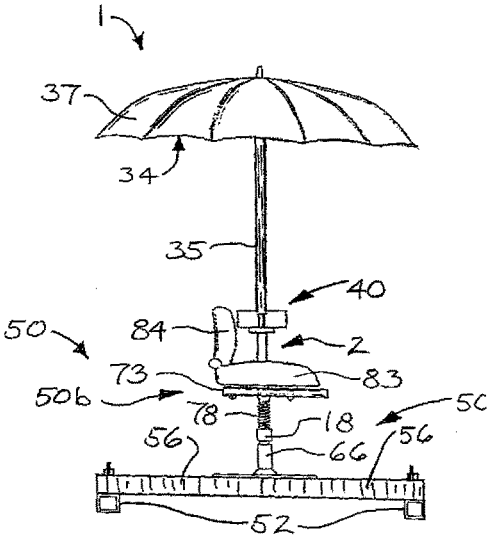
FIG. 12 is a side view of the illustrative watercraft seat accessory adaptor system with the open canopy of the canopy assembly disposed in a left side position relative to the watercraft seat.

As illustrated in FIG. 8, it will be appreciated by those skilled in the art that the base segment 6 on the accessory support member 2 may be fabricated with a length such that the accessory mount segment 12 is deployed at a sufficient clearance distance 10 beyond the seat edge 85 of the seat portion 83 on the watercraft seat 82 to facilitate 360-degree rotation of the accessory support member 2 around the seat portion 83 as the seat post collar 18 rotates relative to the seat pedestal 70. Thus, as illustrated in FIGS. 9-12, the canopy assembly 34 may be selectively deployed at any desired position relative to the rear (FIG. 9), the right side (FIG. 10), the front (FIG. 11) or the left side (FIG. 12) of the watercraft seat 82. Accordingly, the canopy assembly 34 may be positioned and secured at a selected position relative to the front, sides or rear of the watercraft seat 82 typically by initially loosening the knob shaft 17 on the hand-adjustable knob 16 from engagement against the seat pedestal 70 on the seat portion 50*b* of the watercraft seat mount assembly 50, followed by rotation of the accessory support member 2 and the canopy assembly 34 to the desired position and then retightening of the knob shaft 17 against the seat pedestal 70. This expedient may be particularly beneficial for a fisher (not illustrated) as he or she sits in the watercraft seat 82 and desires to cast a fishing lure (not illustrated) in a selected direction from the watercraft 80 without hindrance by the watercraft seat accessory adaptor system 1 and canopy assembly 34 while remaining shaded by the canopy 37.

As illustrated in FIG. 4, in some embodiments, the canopy assembly 34 may include an umbrella of any desired size and brand. The canopy assembly 34 may generally include a generally elongated canopy assembly shaft 35. A canopy assembly socket 36 may terminate the canopy assembly shaft 35. A foldable canopy 37 may be provided on the canopy assembly shaft 35. The canopy 37 may be selectively deployable between an open configuration (FIG. 1) and a closed configuration (FIG. 2).

As further illustrated in FIG. 4, an accessory mount adaptor 28 may facilitate mounting of the canopy assembly receptacle 36 of the canopy assembly 34 on the accessory mount segment 12 of the accessory support member 2. The accessory mount adaptor 28 may be generally elongated and tubular with a proximal adaptor end 29 which may be telescopically inserted into the distal mount segment end 14 of the accessory mount segment 12 and a distal adaptor end 30 which may be inserted into the canopy assembly socket 36. In some embodiments, the accessory mount adaptor 28 may be suitably adapted for selective height adjustment in the accessory mount segment 12. Accordingly, multiple, spaced-apart adaptor adjustment openings 31 may be provided in the accessory mount adaptor 28 between the proximal adaptor end 29 and the distal adaptor end 30. At least one pin opening (not illustrated) may be provided in the accessory mount segment 12. An adjustment pin (not illustrated) may be inserted through the pin opening in the accessory mount segment 12 and through a registering companion adaptor adjustment opening 31 in the accessory mount adaptor 28 to mount the accessory mount adaptor 28 at a selected height or selected length of extension from the accessory mount segment 12. Alternative methods known by those skilled in the art may be used to adjustably mount the accessory mount adaptor 28 relative to the accessory mount segment 12.

Figure 13:
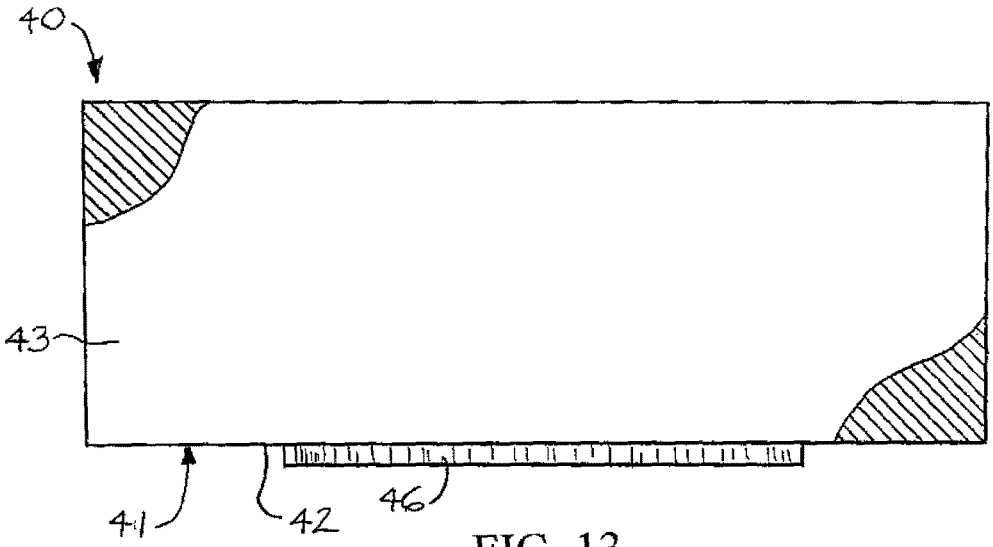
FIG. 13 is a front view of a typical caddy suitable for implementation of an illustrative embodiment of the watercraft seat accessory adaptor systems.
Figure 14:
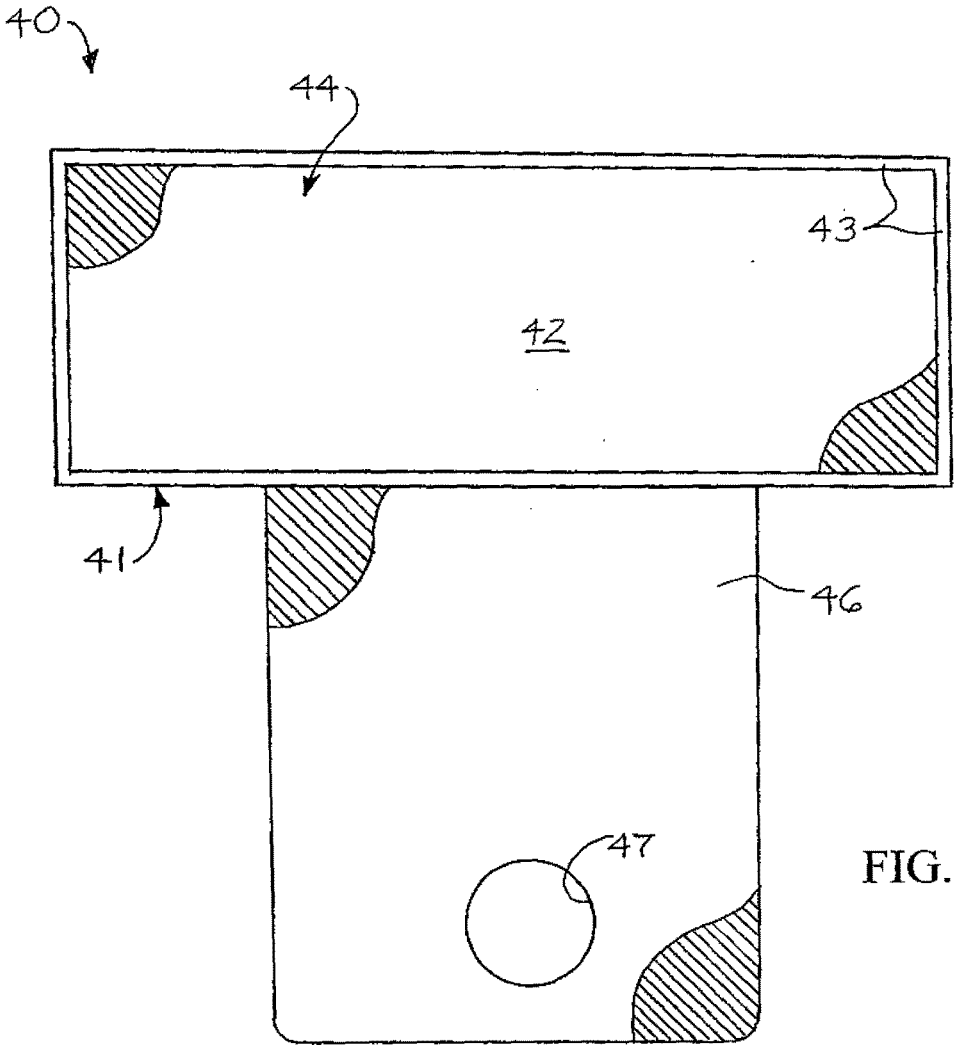
FIG. 14 is a top view of the caddy illustrated in FIG. 13.

In some embodiments, a caddy 40 may be supported by the accessory support member 2 for the purpose of containing or holding various articles such as fishing supplies, beverages and cell phones or other electronic devices, for example and without limitation. As illustrated in FIGS. 13 and 14, in some embodiments, the caddy 40 may include a caddy receptacle 41. The caddy receptacle 41 may include a caddy receptacle bottom 42, a caddy receptacle wall 43 which extends from the caddy receptacle bottom 42 and a caddy receptacle interior 44 which is sized and configured to contain the various articles (not illustrated).

Figure 17:
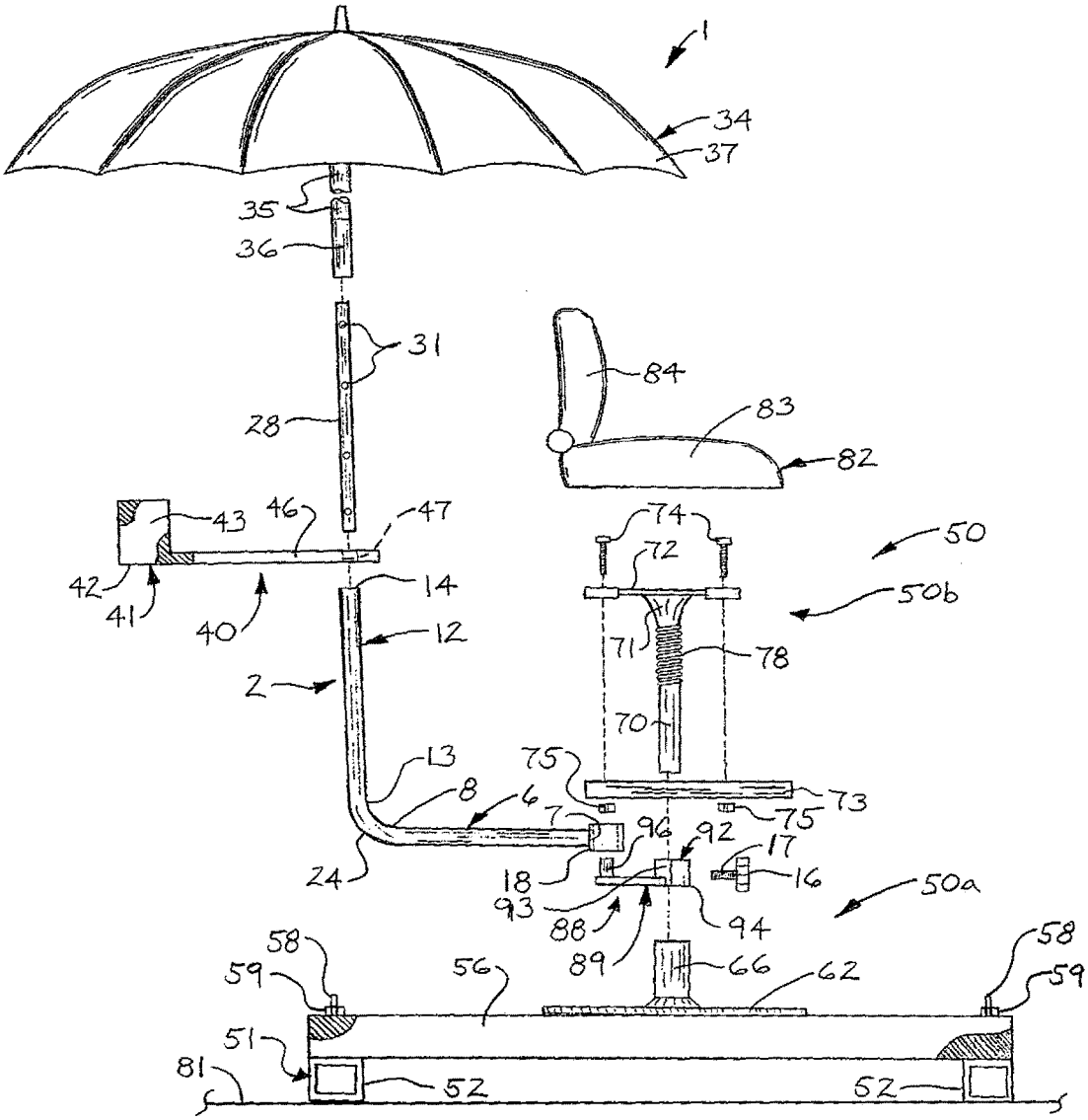
FIG. 17 is an exploded side view of an illustrative watercraft seat accessory adaptor system with the pedestal adaptor illustrated in FIGS. 15 and 16 mounting the accessory support member on the seat mount assembly according to some applications of the watercraft seat accessory adaptor systems.

The caddy 40 may be mounted on the accessory support member 2 according to any technique which is known by those skilled in the art and suitable for the purpose. In some embodiments, a caddy mount flange 46 may extend from the caddy receptacle 41. A flange opening 47 (FIG. 14) may extend through the caddy mount flange 46. As illustrated in FIG. 17, the flange opening 47 may be suitably sized and shaped to receive and accommodate the accessory mount adaptor 28 and smaller in width or diameter than the accessory mount segment 12 of the accessory support member 2 to mount the caddy 40 on the distal mount segment end 14 on the accessory mount segment 12. Thus, the caddy receptacle 41 of the caddy 40 may be deployed in an accessible location for a fisher (not illustrated) to access the articles in the caddy receptacle interior 44 as he or she sits in the watercraft seat 82.

In typical application, at least one watercraft seat accessory adaptor system 1 may be installed on at least one watercraft seat 82 in a watercraft 80, which may be conventional. In the non-limiting example illustrated in FIGS. 1 and 2, a pair of watercraft seat accessory systems 1 is installed on a front watercraft seat 82*a* and a rear watercraft seat 82*b*, respectively, on the watercraft 80. Accordingly, as illustrated in FIG. 4, the seat pedestal 70 of the seat portion 50*b* may initially be removed from the seat post receptacle 66 of the base portion 50*a* of the watercraft seat mount assembly 50. The collar interior 19 (FIG. 7) of the seat post collar 18 on the base segment 6 of the accessory support member 2 may then receive and accommodate the seat pedestal 70, which may then be re-inserted into the seat post receptacle 66. The seat spring 78 may be interposed between the seat post collar 18 and the pedestal head 71 on the seat pedestal 70 to cushion the watercraft seat 82 on the watercraft seat mount assembly 50.

The canopy assembly 34 may next be assembled on the assembly support member 2 typically by telescopic insertion of the proximal adaptor end 29 of the accessory mount adaptor 28 into the distal mount segment end 14 of the accessory mount segment 12, as illustrated in FIG. 4. In some embodiments, the caddy 40 may be installed on the accessory support member 2 typically by first inserting the proximal adaptor end 29 of the accessory mount adaptor 28 through the mount flange opening 47 (FIG. 14) in the caddy mount flange 46 of the caddy 40. In some embodiments, the height of the accessory mount adaptor 28 may be selected by inserting an adjustment pin (not illustrated) through the pin opening (not illustrated) in the accessory mount segment 12 and through a selected registering one of the companion adaptor adjustment openings 31 in the accessory mount adaptor 28. The canopy assembly socket 36 on the canopy assembly shaft 35 of the canopy assembly 34 may then be lowered in place on the distal adaptor end 30 of the accessory mount adaptor 28.

After the accessory mount segment 12 of the accessory support member 2 is adjusted to correspond to the desired position of the canopy assembly 34 relative to the watercraft seat 82, the knob 16 may be rotated to thread the knob shaft 17 in the knob shaft opening 21 (FIG. 7) in the seat post collar 18 on the accessory support member 2 against the seat pedestal 70 to secure the accessory support member 2 at the selected position. The canopy 37 may be deployed from the closed position (FIG. 2) to the open position (FIG. 1) to cover or shade the watercraft seat 82 and its occupant. Various articles (not illustrated) such as fishing supplies, beverages and cell phones or other electronic devices, for example and without limitation, may be placed in the caddy receptacle 41 of the caddy 40 for easy access by the occupant of the watercraft seat 82.

It will be appreciated by those skilled in the art that the canopy assembly 34 can be adjusted to any position around the watercraft seat 82 according to the preferences of the occupant of the watercraft seat 82, as illustrated in FIGS. 8-12. Repositioning of the canopy assembly 34 may be necessary in circumstances such as may arise in the event that the occupant of the watercraft seat 82 desires to cast a fishing lure (not illustrated) in a selected direction from the watercraft 80 and the position of the canopy assembly 34 may otherwise hinder casting of the fishing lure in that direction. Thus, the position of the canopy assembly 34 may be adjusted to the side of the watercraft seat 82 which is opposite the direction in which the occupant desires to cast the fishing lure. This may be accomplished by loosening the knob shaft 17 in the knob shaft opening 21 (FIG. 7) in the seat post collar 18 to disengage the knob shaft 17 from the seat pedestal 70, rotating the accessory support member 2 and attached canopy assembly 34 to the desired position relative to the watercraft seat 82 as the seat post collar 18 rotates relative to the seat pedestal 70, and then retightening the knob shaft 17 against the seat pedestal 70.

Figure 15:
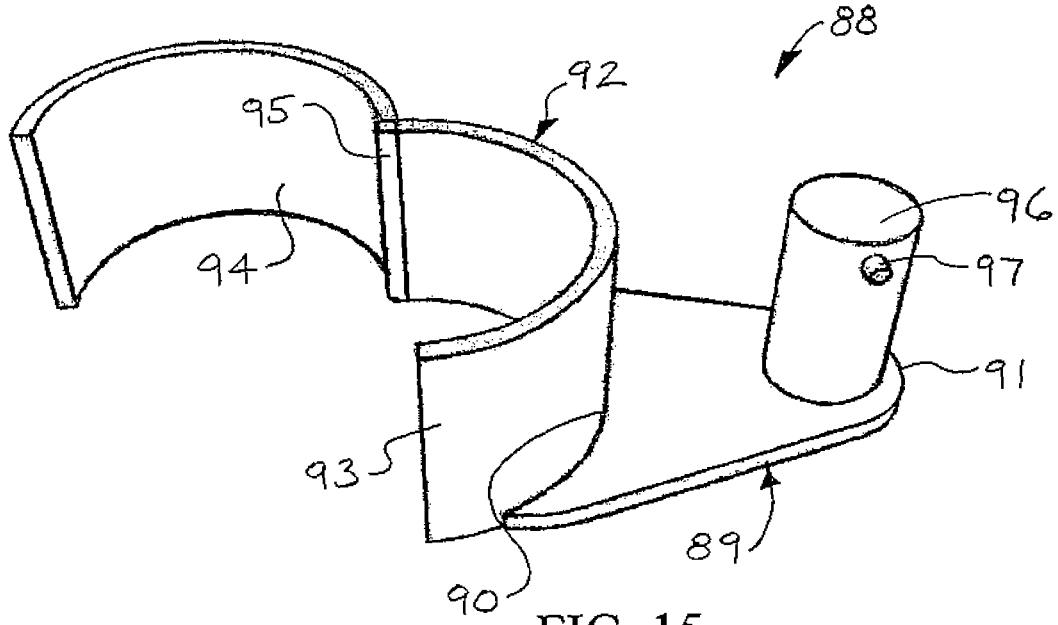
FIG. 15 is a perspective view of a typical pedestal adaptor suitable for mounting the accessory support member on the watercraft seat mount assembly in typical implementation of an illustrative embodiment of the watercraft seat accessory adaptor systems.
Figure 16:
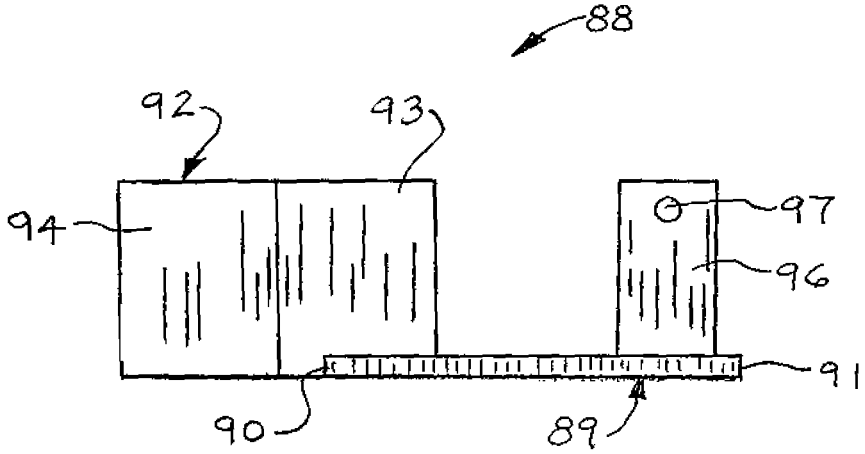
FIG. 16 is a side view of the pedestal adaptor illustrated in FIG. 15.

Referring next to FIGS. 15-18 of the drawings, in some applications of the watercraft seat accessory adaptor system 1, the seat pedestal 70 of the watercraft seat mount assembly 50 may have a size or diameter which exceeds the size or diameter of the collar interior 19 (FIG. 7) of the seat post collar 18 on the base segment 6 of the accessory support member 2. Accordingly, a pedestal adaptor 88 may facilitate coupling of the accessory support member 2 to the seat pedestal 70 having the larger size or diameter. As illustrated in FIGS. 15 and 16, in some embodiments, the pedestal adaptor 88 may include an adaptor base plate 89 which may be generally elongated with a seat pedestal mount end 90 and an accessory adaptor mount end 91. A seat pedestal mount collar 92 may be provided on the seat pedestal mount end 90 of the adaptor base plate 89. The seat pedestal mount collar 92 may be adjustable in size according to the knowledge of those skilled in the art and may include a fixed collar member 93 on the adaptor base plate 89 and a locking collar member 94 which may be pivotally attached to the fixed collar member 93 at a collar hinge 95. A collar locking mechanism (not illustrated) may facilitate locking of the locking collar member 94 to the fixed collar member 93 according to the knowledge of those skilled in the art.

A receptacle post 96 may extend from the pedestal adaptor base plate 89 in spaced-apart relationship to the seat pedestal mount collar 92. A spring-loaded receptacle post pin 97 may be provided on the receptacle post 96.

Figure 18:
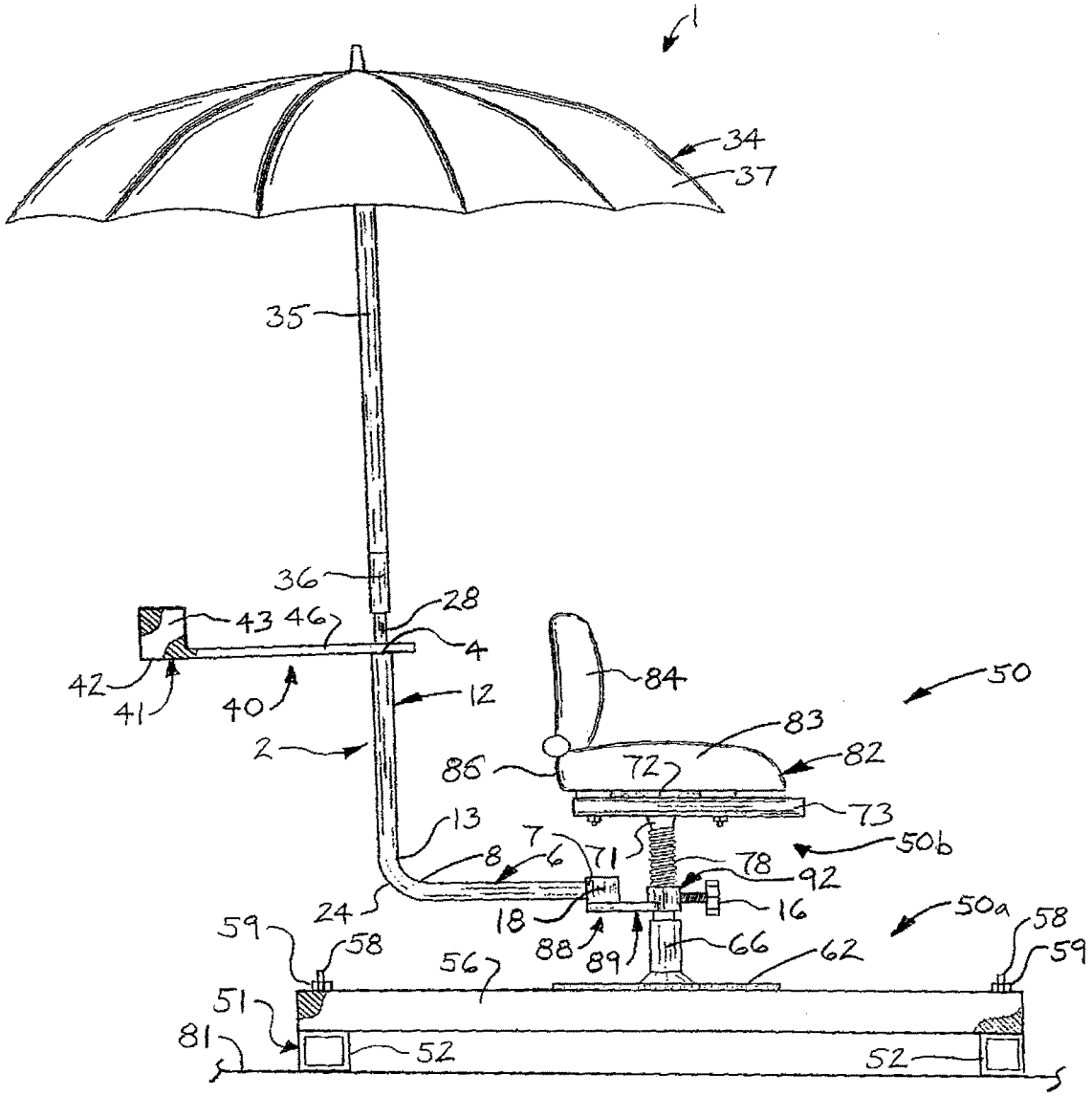
FIG. 18 is a side view of the illustrative watercraft seat accessory adaptor system illustrated in FIG. 17 with the pedestal adaptor of FIGS. 15 and 16 mounting the accessory support member on the seat mount assembly according to some applications of the watercraft seat accessory adaptor systems.

As illustrated in FIGS. 17 and 18, the pedestal adaptor 88 may be installed on the watercraft seat mount assembly 50 by opening the seat pedestal mount collar 92, placing the seat pedestal mount collar 92 around the seat pedestal 70 and locking the locking collar member 94 to the fixed collar member 93. The seat post collar 18 on the base segment 6 of the accessory support member 2 may be placed over the receptacle post 96 of the pedestal adaptor 88. In some embodiments, a pin opening (not illustrated) may be provided in the seat post collar 18. Thus, the spring-loaded receptacle post pin 97 (FIG. 16) on the receptacle post 96 of the pedestal adaptor 88 may snap into the registering pin opening in the seat post collar 18 to secure the seat post collar 18 on the receptacle post 96. The seat post collar 18 may be subsequently removed from the receptacle post 96 by pushing the receptacle post pin 97 into the pin opening in the seat post collar 18 and lifting the seat post collar 18 from the receptacle post 96. The canopy assembly 34 on the accessory support member 2 may be placed at the desired position relative to the watercraft seat 82 as the seat pedestal mount collar 92 of the pedestal adaptor 88 rotates relative to the seat pedestal 70. In some embodiments, a knob shaft opening (not illustrated) may be provided in the locking collar member 94 of the seat pedestal mount collar 92 of the pedestal adaptor 88. The knob shaft 17 of the knob 16 may be threaded through the knob shaft opening and tightened against the seat pedestal 70 to secure the seat pedestal mount collar 92 of the pedestal adaptor 88 on the seat pedestal 70 at the selected position of the canopy assembly 34 relative to the watercraft seat 82.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A watercraft seat accessory adaptor system for mounting a canopy assembly on a watercraft, comprising:
- a watercraft seat mount assembly including:
  - a base portion having a base plate and a seat post receptacle carried by the base plate;
  - a seat portion carried by the base portion, the seat portion having a seat pedestal inserted in the seat post receptacle of the base portion; and
  - a watercraft seat carried by the seat pedestal of the seat portion, the watercraft seat having a seat edge; and
- an accessory support member including:
  - an elongated base segment carried by the seat pedestal of the seat portion of the watercraft seat mount assembly in rotatable relation to the seat pedestal;
  - a pedestal adaptor including a seat pedestal mount collar having a fixed collar member carried by the base segment, a locking collar member and a collar hinge pivotally mounting the locking collar member to the fixed collar member, the seat pedestal mount collar adjustable in size to accommodate a seat pedestal of selected size; and
  - an accessory mount segment carried by the base segment, the accessory mount segment configured for mounting the canopy assembly, the base segment of the accessory support member having a length such that the accessory mount segment is deployed at a sufficient clearance distance beyond the seat edge of the watercraft seat to facilitate 360-degree rotation of the accessory support member around the watercraft seat; and
- an accessory mount adaptor telescopically carried by the accessory mount segment of the accessory support member, the accessory mount adaptor configured to adjustably and telescopically mount the canopy assembly on the accessory support member at a selected height with respect to the watercraft seat.

2. The watercraft seat accessory adaptor system of claim 1 further comprising a seat post collar carried by the base segment of the accessory support member, and wherein the seat post collar is carried by the pedestal adaptor.

3. The watercraft seat accessory adaptor system of claim 2 wherein the pedestal adaptor comprises a pedestal adaptor base plate and the fixed collar member of the seat pedestal mount collar is carried by the pedestal adaptor base plate, and further comprising a receptacle post extending from the pedestal adaptor base plate in spaced-apart relationship to the seat pedestal mount collar and extending through the seat post collar.

4. The watercraft seat accessory adaptor system of claim 1 wherein the accessory mount segment is disposed in generally perpendicular relationship to the base segment of the accessory support member.

5. The watercraft seat accessory adaptor system of claim 1 wherein the accessory support member comprises a support member wall and a support member interior formed by the support member wall.

6. The watercraft seat accessory adaptor system of claim 1 further comprising a caddy carried by the accessory support member.

7. The watercraft seat accessory adaptor system of claim 6 wherein the caddy comprises a caddy support flange carried by the accessory support member and a caddy receptacle carried by the caddy support flange.

8. A watercraft seat accessory adaptor system for mounting a canopy assembly on a watercraft, comprising:
- a watercraft seat mount assembly including:
  - a base portion having a base plate and a seat post receptacle carried by the base plate;
  - a seat portion carried by the base portion, the seat portion having a seat edge and a seat pedestal inserted in the seat post receptacle of the base portion; and a watercraft seat carried by the seat pedestal of the seat portion;

a pedestal adaptor including a pedestal adaptor base plate, a seat pedestal mount collar carried by the pedestal adaptor base plate and receiving the seat pedestal and a receptacle post carried by the pedestal adaptor base plate in spaced-apart relationship to the seat pedestal mount collar, the seat pedestal mount collar adjustable in size to accommodate a seat pedestal of selected size;

an accessory support member including:

an elongated base segment carried by the receptacle post of the pedestal adaptor; and an accessory mount segment carried by the base segment, the accessory mount segment configured for mounting the canopy assembly; and an accessory mount adaptor telescopically carried by the accessory mount segment of the accessory support member, the accessory mount adaptor configured to adjustably and telescopically mount the canopy assembly on the accessory support member at a selected height with respect to the watercraft seat.

9. The watercraft seat accessory adaptor system of claim 8 wherein the accessory mount segment is disposed in generally perpendicular relationship to the base segment of the accessory support member.

10. The watercraft seat accessory adaptor system of claim 8 wherein the accessory support member comprises a support member wall and a support member interior formed by the support member wall.

11. The watercraft seat accessory adaptor system of claim 8 further comprising a caddy carried by the accessory support member.

* * * * *